United States Patent [19]

McClaflin

[11] 4,246,919

[45] Jan. 27, 1981

[54] METHOD OF TRANSPORTING VISCOUS HYDROCARBONS

[75] Inventor: Gifford G. McClaflin, Ponca City, Okla.

[73] Assignee: Conoco, Inc., Ponca City, Okla.

[21] Appl. No.: 968,880

[22] Filed: Dec. 13, 1978

[51] Int. Cl.[3] ..... F17D 1/17

[52] U.S. Cl. ..... 137/13; 252/8.55 R

[58] Field of Search ..... 252/8.3, 8.55 R; 137/13; 406/48, 49

[56] References Cited

U.S. PATENT DOCUMENTS

| | | | |
|---|---|---|---|
| 3,380,531 | 4/1968 | McAuliffe et al. | 166/314 |
| 3,398,094 | 8/1968 | Blatz et al. | 252/8.55 |
| 3,467,195 | 9/1969 | McAuliffe et al. | 166/314 |
| 3,491,835 | 1/1970 | Gagle | 166/275 X |
| 3,735,770 | 5/1973 | Day et al. | 137/13 |
| 3,943,954 | 3/1976 | Flournoy et al. | 137/13 |

OTHER PUBLICATIONS

Becher, *Emulsions: Theory and Practice,* Second Edition, Pub. 1965 by Reinhold Pub. Corp. pp. 221–223.

"Presenting the Pluronic 'Grid'," Article in *Chemical and Engineering News,* vol. 34, Jan. 30, 1956, pp. 477–480.

*Primary Examiner*—Herbert B. Guynn

*Attorney, Agent, or Firm*—Bayless E. Rutherford, Jr.

[57] ABSTRACT

An improvement in the method of transporting viscous hydrocarbons through pipes is disclosed. Briefly, the improvement comprises adding water containing an effective amount of a combination of an ethoxylated alkyl phenol and an ethoxylated polypropylene glycol. The resulting emulsion has a lower viscosity and is more easily transported.

9 Claims, No Drawings

METHOD OF TRANSPORTING VISCOUS HYDROCARBONS

BACKGROUND OF THE INVENTION

Field of the Invention

The invention is in the general field of improved methods of pumping viscous hydrocarbons through a pipe, such as a well-bore or a pipeline.

General Background

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

Still another method of moving heavy crudes through pipes uses oil-in-water emulsions which use surfactants to form the emulsions.

Still further, it is known to reduce the viscosity of viscous crudes by the use of an aqueous solution containing an ethoxylated alkyl phenol or this material in combination with a copolymer of ethylene and a polar organic compound (e.g. as acetate).

I have found that use of an aqueous solution containing a combination of an ethoxylated alkyl phenol and an ethoxylated polypropylene glycol provides better viscosity reduction than use of either material alone. Furthermore, certain combinations of ethoxylated alkyl phenol and ethoxylated polypropylene glycol provide even better results.

BRIEF SUMMARY OF THE INVENTION

Briefly stated, the present invention is directed to an improvement in the method of pumping a viscous hydrocarbon through a pipe wherein the improvement comprises forming an oil-in-water emulsion by adding to said hydrocarbon from about 20 to about 80 volume percent water containing an effective amount of a combination of an ethoxylated alkyl phenol and an ethoxylated polypropylene glycol.

The specific nature of the ethoxylated alkyl phenol and ethoxylated polypropylene glycol are provided in the detailed description.

DETAILED DESCRIPTION

Insofar as is known our method is suitable for use with any viscous crude oil. It is well known that crude oils often contain a minor amount of water.

The amount of water which is added to the hydrocarbon is suitably in the range of about 20 to about 80 volume percent based on the hydrocarbon. A preferred amount of water is in the range of about 30 to 60 volume percent. The water can be pure or can have a relatively high amount of dissolved solids. Any water normally found in the proximity of a producing oil-well is suitable.

Suitable ethoxylated alkyl phenols are mono- or dialkyls, wherein each alkyl group contains from about 8 to 12 carbon atoms, and which contain from about 20 to about 100 ethoxy grouups, preferably from about 30 to about 70 ethoxy groups. The preferred ethoxylated alkyl phenol is a monoalkylphenol containing 8 to 10 carbon atoms in the alkyl group.

Suitable ethoxylated polypropylene glycols are those containing from about 10 to about 60 weight percent ethylene oxide and having a molecular weight in the range of about 1300 to about 2900. The preferred ethoxylated polypropylene glycols are those containing from about 20 to about 50 weight percent ethylene oxide and having a molecular weight in the range of about 1500 to about 2500.

While any ethoxylated alkyl phenol meeting the foregoing description is suitable commercial materials are available from Thompson-Hayward Chemical Company under the tradenames T-DET N-20, T-DET DD-30, T-DET N-407 and T-DET N-507.

While any ethoxylated polypropylene glycol meeting the foregoing description is suitable, commercial materials are available from Wyandotte Chemicals Corp., a division of BASF, under the tradename "Pluronic" (e.g. Pluronic L-44).

Suitable and preferred amounts of the ethoxylated alkyl phenols and ethoxylated polypropylene glycols, based on the hydrocarbon, are shown below.

| | Suitable (parts per million) | Preferred (parts per million) |
|---|---|---|
| Ethoxylated alkyl phenol | 50–10,000 | 100–1,000 |
| Ethoxylated polypropylene glycol | 50–10,000 | 100–1,000 |

In order to illustrate the nature of the present invention still more clearly the following examples will be given. It is to be understood, however, that the invention is not to be limited to the specific conditions or details set forth in these examples except insofar as such limitations are specified in the appended claims.

The following materials were used in the tests described herein:

Crude Oil—Goodwin lease crude from Cat Canyon oil field, Santa Maria, California Water—Goodwin synthetic (Water prepared in laboratory to simulate water produced at the well. It contained 4720 ppm total solids.)

The specific composition of the surfactant materials tested will be given in the examples.

Viscosities were determined using a Brookfield viscometer, Model LVT with No. 3 spindle. The procedure is described below.

TEST PROCEDURE

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60. Viscosity was calculated by using a multiplication factor of 200, 100, 40 and 20 for the respective speeds times the dial reading on the viscometer.

It may be well to mention that the final result at 6 RPM is an indication of the stability of the solution being tested.

The difference in viscosity values on the crude alone in the examples is due to the varying amount of water naturally present in the crude. For this reason the viscosity value of the crude alone was obtained in each example. The crude corresponded to that used in combination with the aqueous surfactant.

EXAMPLE 1

This example is comparative and shows the viscosity values obtained on the crude alone and a combination of 50 volume percent crude and 50 volume percent water which contained 500 ppm of an ethoxylated nonyl phenol containing 40 moles of ethylene oxide per mole of nonyl phenol (T-DET N-407).

The results are shown in Table 1.

TABLE 1

| Goodwin Crude Oil Alone (300 ml) | | Goodwin Crude Oil Plus 300 ml Goodwin Synthetic Water Containing 500 ppm T-DET N-407 | | | | |
|---|---|---|---|---|---|---|
| | | | Dial Reading | | Viscosity cp | |
| RPM | Viscosity cp | RPM | No. 1 | No. 2* | No. 1 | No. 2 |
| 6 | 4,400 | 6 | 1 | 13 | 200 | 2,600 |
| 12 | 4,450 | 12 | 1.75 | 15 | 175 | 1,500 |
| 30 | 4,000 | 30 | 2 | 13 | 80 | 520 |
| 60 | Off Scale | 60 | 4 | 12 | 80 | 240 |
| 30 | 3,800 | 30 | 2.5 | 11.5 | 100 | 460 |
| 12 | 3,750 | 12 | 1.75 | 7 | 175 | 700 |
| 6 | 3,700 | 6 | 1.5 | 4.8 | 300 | 960 |
| Test Temperature °F. 195 | | Test Temperature °F. 165(1) 155(2) | | | | |

*Stopped stirrer, then waited two minutes before starting viscosity measurements.
(1)temperature - first test
(2)temperature - second (delayed) test

EXAMPLE 2

This example is comparative and shows the viscosity values obtained on the crude alone and a combination of 50 volume percent crude and 50 volume percent water which contained 500 ppm of an ethoxylated nonyl phenol containing 50 moles of ethylene oxide per mole of nonyl phenol (T-DET N-507).

The results are shown in Table 2.

TABLE 2

| Goodwin Crude Oil Alone (300 ml) | | Goodwin Crude Oil Plus 300 ml Goodwin Synthetic Water Containing 500 ppm T-DET N-507 | | | | |
|---|---|---|---|---|---|---|
| | | | Dial Reading | | Viscosity cp | |
| RPM | Viscosity cp | RPM | No. 1 | No. 2* | No. 1 | No. 2 |
| 6 | 5,100 | 6 | 1.5 | 4 | 200 | 800 |
| 12 | 4,500 | 12 | 1.5 | 4.5 | 150 | 450 |
| 30 | 3,800 | 30 | 2.5 | 6 | 100 | 240 |
| 60 | Off Scale | 60 | 4 | 10 | 80 | 200 |
| 30 | 3,920 | 30 | 2 | 6 | 80 | 240 |
| 12 | 4,450 | 12 | 1.4 | 4 | 140 | 400 |
| 6 | 4,400 | 6 | 1.2 | 3.5 | 240 | 700 |
| Test Temperature °F. 190 | | Test Temperature °F. 160(1) 145(2) | | | | |

*Stopped stirrer, then waited two minutes before starting viscosity measurements.

EXAMPLE 3

This example is comparative and shows the viscosity values obtained on the crude alone and a combination of 50 volume percent crude and 50 volume percent water which contained 500 ppm of an ethoxylated polypropylene glycol containing 40 percent ethylene oxide and having a molecular weight of 2,000 (Pluronic L-44).

The results are shown in Table 3.

TABLE 3

| Goodwin Crude Oil Alone (300 ml) | | Goodwin Crude Oil Plus 300 ml Goodwin Synthetic Water Containing 500 ppm Pluronic L-44 | | | | |
|---|---|---|---|---|---|---|
| | | | Dial Reading | | Viscosity cp | |
| RPM | Viscosity cp | RPM | No. 1 | No. 2* | No. 1 | No. 2 |
| 6 | 3,500 | 6 | 1 | OFF Scale | 200 | Off Scale |
| 12 | 3,300 | 12 | 1.2 | Off Scale | 120 | Off Scale |
| 30 | 3,480 | 30 | 3 | Off Scale | 120 | Off Scale |
| 60 | Off Scale | 60 | 6 | Off Scale | 120 | Off Scale |
| 30 | 3,520 | 30 | 1 | Off Scale | 40 | Off Scale |
| 12 | 3,608 | 12 | 2 | Off Scale | 200 Scale | Off |
| 6 | 3,100 | 6 | 2.5 | Off Scale | 500 | Off Scale |
| Test Temperature °F. 200 | | Test Temperature °F. 160(1) 150(2) | | | | |

*Stopped stirrer, then waited two minutes before starting viscosity measurements.

EXAMPLE 4

This example is illustrative and shows viscosity values obtained on the crude alone and a combination of 50 volume percent crude and 50 volume percent water which contained 400 ppm of the ethoxylated nonyl phenol of Example 2 (T-DET N-507) and 100 ppm of the ethoxylated polypropylene glycol of Example 3 (Pluronic L-44).

The results are shown in Table 4.

TABLE 4

| Goodwin Crude Oil Alone (300 ml) | | Goodwin Crude Oil Plus 300 ml Goodwin Synthetic Water Containing 400 ppm T-DET N-507 and 100 ppm Pluronic L-44 | | | | |
|---|---|---|---|---|---|---|
| | | | Dial Reading | | Viscosity cp | |
| RPM | Viscosity cp | RPM | No. 1 | No. 2* | No. 1 | No. 2 |
| 6 | 3,900 | 6 | 0.6 | 0.6 | 120 | 120 |
| 12 | 4,400 | 12 | 0.8 | 0.8 | 80 | 80 |
| 30 | Off Scale | 30 | 1.5 | 1.0 | 60 | 40 |
| 60 | Off Scale | 60 | 5.0 | 4.5 | 100 | 90 |
| 30 | Off Scale | 30 | 2.5 | 1.5 | 100 | 60 |
| 12 | 4,700 | 12 | 2.5 | 1.5 | 250 | 150 |
| 6 | 4,400 | 6 | 1.5 | 1.5 | 440 | 300 |
| Test Temperature °F. 200 | | Test Temperature °F. 170(1) 155(2) | | | | |

*Stopped stirrer, then waited two minutes before starting viscosity measurements.

EXAMPLE 5

This example is illustrative and shows viscosity values obtained on the crude alone and a combination of 50 volume percent crude and 50 volume percent water which contained 400 ppm of the ethoxylated nonyl phenol of Example 1 (T-DET N-407) and 100 ppm of the ethoxylated polypropylene glycol of Example 3 (Pluronic L-44).

The results are shown in Table 5.

TABLE 5

| Goodwin Crude Oil Alone and 100 ppm Pluronic L-44 (300 ml) | | Goodwin Crude Oil Plus 300 ml Goodwin Synthetic Water Containing 400 ppm T-DET N-407 | | | | |
|---|---|---|---|---|---|---|
| | | | Dial Reading | | Viscosity cp | |
| RPM | Viscosity cp | RPM | No. 1 | No. 2* | No. 1 | No. 2 |
| 6 | 2,200 | 6 | 0.5 | 6 | 100 | 1,200 |
| 12 | 2,200 | 12 | 1.5 | 3.5 | 150 | 350 |
| 30 | 1,760 | 30 | 3 | 3.5 | 120 | 140 |
| 60 | Off Scale | 60 | 5 | 6 | 100 | 120 |
| 30 | 2,040 | 30 | 3 | 3 | 120 | 120 |
| 12 | 2,000 | 12 | 2 | 2.5 | 200 | 250 |
| 6 | 1,900 | 6 | 1.75 | 2.0 | 350 | 400 |
| Test Temperature °F. 200 | | Test Temperature °F. 170(1) 160(2) | | | | |

Stopped stirrer, then waited two minutes before starting viscosity measurements.

Thus, having described the invention in detail, it will be understood by those skilled in the art that certain variations and modifications may be made without departing from the spirit and scope of the invention as defined herein and in the appended claims.

I claim:

1. In the method of pumping a viscous hydrocarbon through a pipe the improvement which comprises forming an oil-in-water emulsion by adding to said hydrocarbon from about 20 to about 80 volume percent of an aqueous solution containing an effective amount, based on said hydrocarbon, of a combination of about 50 to about 10,000 parts per million of an ethoxylated alkyl phenol and about 50 to about 10,000 parts per million of an ethoxylated polypropylene glycol, said ethoxylated alkyl phenol being a monoalkyl phenol, wherein the alkyl group contains from about 8 to about 10 carbon atoms, and which contains from about 30 to about 70 ethoxy groups and said ethoxylated polypropylene glycol contains about 10 to about 50 weight percent ethylene oxide and has a molecular weight in the range of about 1300 to about 2900.

2. The method of claim 1 wherein the ethoxylated polypropylene glycol contains from about 20 to about 50 weight percent ethylene oxide and has a molecular weight in the range of about 1500 to about 2500.

3. The method of claim 2 wherein said hydrocarbon is a crude oil.

4. The method of claim 1 wherein the amount of aqueous solution added to said hydrocarbon is in the range of about 30 to about 60 volume percent, based on said hydrocarbon.

5. The method of claim 4 wherein the aqueous solution contains, based on said hydrocarbon, a combination of about 100 to about 1,000 parts per million of an ethoxylated alkyl phenol and about 100 to about 1,000 parts per million of an ethoxylated polypropylene glycol.

6. The method of claim 5 wherein the ethoxylated polypropylene glycol contains from about 20 to about 50 weight percent ethylene oxide and has a molecular weight in the range of about 1500 to about 2500.

7. The method of claim 6 wherein said hydrocarbon is a crude oil.

8. The method of claim 1 wherein (a) the amount of aqueous solution added to said hydrocarbon is about 50 volume percent, (b) the amount of the ethoxylated alkyl phenol is about 400 parts per million, (c) the amount of ethoxylated polypropylene glycol is about 100 parts per million, and (d) the ethoxylated polypropylene glycol contains 40 weight percent ethylene oxide and has a molecular weight of 2,000.

9. The method of claim 8 wherein the ethoxylated alkyl phenol is selected from the group consisting of ethoxylated nonyl phenol containing 40 moles of ethylene oxide and ethoxylated nonyl phenol containing 50 moles of ethylene oxide.

* * * * *